United States Patent [19]

Bhula

[11] 4,427,320

[45] Jan. 24, 1984

[54] ARCTIC OFFSHORE PLATFORM

[75] Inventor: Dilipkumar N. Bhula, Houston, Tex.

[73] Assignee: Shell Oil Company, Houston, Tex.

[21] Appl. No.: 350,458

[22] Filed: Feb. 19, 1982

[51] Int. Cl.[3] ..... E02B 17/00

[52] U.S. Cl. ..... 405/211; 405/217

[58] Field of Search ..... 405/61, 195, 211, 217

[56] References Cited

U.S. PATENT DOCUMENTS

| | | | |
|---|---|---|---|
| 4,215,952 | 8/1980 | Baardsen | 405/211 |
| 4,252,471 | 2/1981 | Straub | 405/211 |
| 4,335,980 | 6/1982 | DePriester | 405/217 |

FOREIGN PATENT DOCUMENTS

| | | | |
|---|---|---|---|
| 1081483 | 7/1980 | Canada | 405/211 |

*Primary Examiner*—David H. Corbin

[57] ABSTRACT

An offshore structure for use in drilling and producing wells in arctic regions having a conical shaped lower portion that extends above the surface of the water and a cylindrical upper section. The conical portion is provided with a controlled stiffness outer surface for withstanding the loads produced by ice striking the structure. The stiffness properties of the outer shell and flexible members are designed to distribute the load and avoid high local loads on the inner parts of the structure.

6 Claims, 6 Drawing Figures

ARCTIC OFFSHORE PLATFORM

BACKGROUND OF THE INVENTION

The present invention relates to offshore structures and particularly structures for conducting drilling and producing operations in the Arctic regions. More particularly, the structure is particularly adapted for conducting operations in the shallow waters of the Beaufort Sea. As is well known, the Beaufort Sea at particular times of the year contains large movements of relatively thick sea ice and offshore drilling structures must withstand this movement. In the past, it has been suggested that any offshore structures based in the shallow waters of the Beaufort Sea have a conical base section to force the moving ice upward, causing it to break due to the tension forces imposed upon the ice. This will cause the large ice features to break into smaller pieces which then can pass safely around the offshore structure.

While the use of conical-shaped bottom sections obviously solves the problem of breaking the large moving ice sheets into smaller sections, the problem still remains of how to provide an outer skin for the conical section that can withstand the loads imposed by the moving ice sheets. One solution suggested by the prior art is described in U.S. Pat No. 4,215,952 where a resilient material is disposed between the wear surface of the conical base section and the support portion thereof. The use of the resilient section is intended to reduce loads imposed upon the structure by the large ice floes. While this is a possible solution, it requires the use of relatively flexible outer surfaces on the conical base in order that the load can be transmitted to the resilient material positioned between the support structure and the outer surface. The key design problem is to avoid excessive concentration of load on the supporting bulkheads.

BRIEF DESCRIPTION OF THE INVENTION

The present invention solves the above problems by spreading the load over a larger area before it is transferred to the bulkheads. This is achieved by using a stiff conical outer shell which is supported by a system of beams spanning between radial bulkheads. When the ice load is applied to the stiff outer shell it, in turn, transfers the load to the supporting beams. Since these beams are more compliant than the outer shell they will deflect, permitting the shell to move inward and transfer the load to adjacent sets of beams.

The upper end of the conical outer shell is attached to a cylindrical upper shell which houses three decks which contains the drilling and production equipment.

The entire structure may be constructed in a less hostile environment, towed to location under its own buoyancy, and installed on location by water ballasting. It will resist ice and wave loads by a gravity foundation using a system of steel skirts to transfer the loads into the foundation soil.

BRIEF DESCRIPTION OF THE DRAWINGS

The present invention is more easily understood from the following description when taken in conjunction with the attached drawings in which.

DESCRIPTION OF PREFERRED EMBODIMENTS

The structure of the present invention is designed to resist loads due to first year and multiyear ice sheets and ridges, rubble piles and dynamic impacts from storms accompanied by ice invasions. The overall form of the structure comprises a frustum of a cone for the lower portion with a base diameter, for example, of 350 feet. The base portion has a cone angle of typically 45 degrees and is joined to a cylindrical upper section. The upper section contains the drilling and production equipment and facilities.

The conical portion of the structure consist of a system of radial and circumferential bulkheads supported by a continuous base plate. The ice and wave loads are borne by a stiff outer shell comprising an orthotropic structural system consisting of radial and meridional webs and top and bottom flanges. The outer shell transfers the loads to a bulkhead system through an indirect load path created by supporting the outer shell on a system of flexible beams which span the space between the radial bulkheads. The stiffness properties of the outer shell and flexible beams are selected to distribute the load over a number of bulkheads instead of a single bulkhead. This avoids the imposition of high local loads on individual bulkheads as is the case with previous designs.

Figure 1:
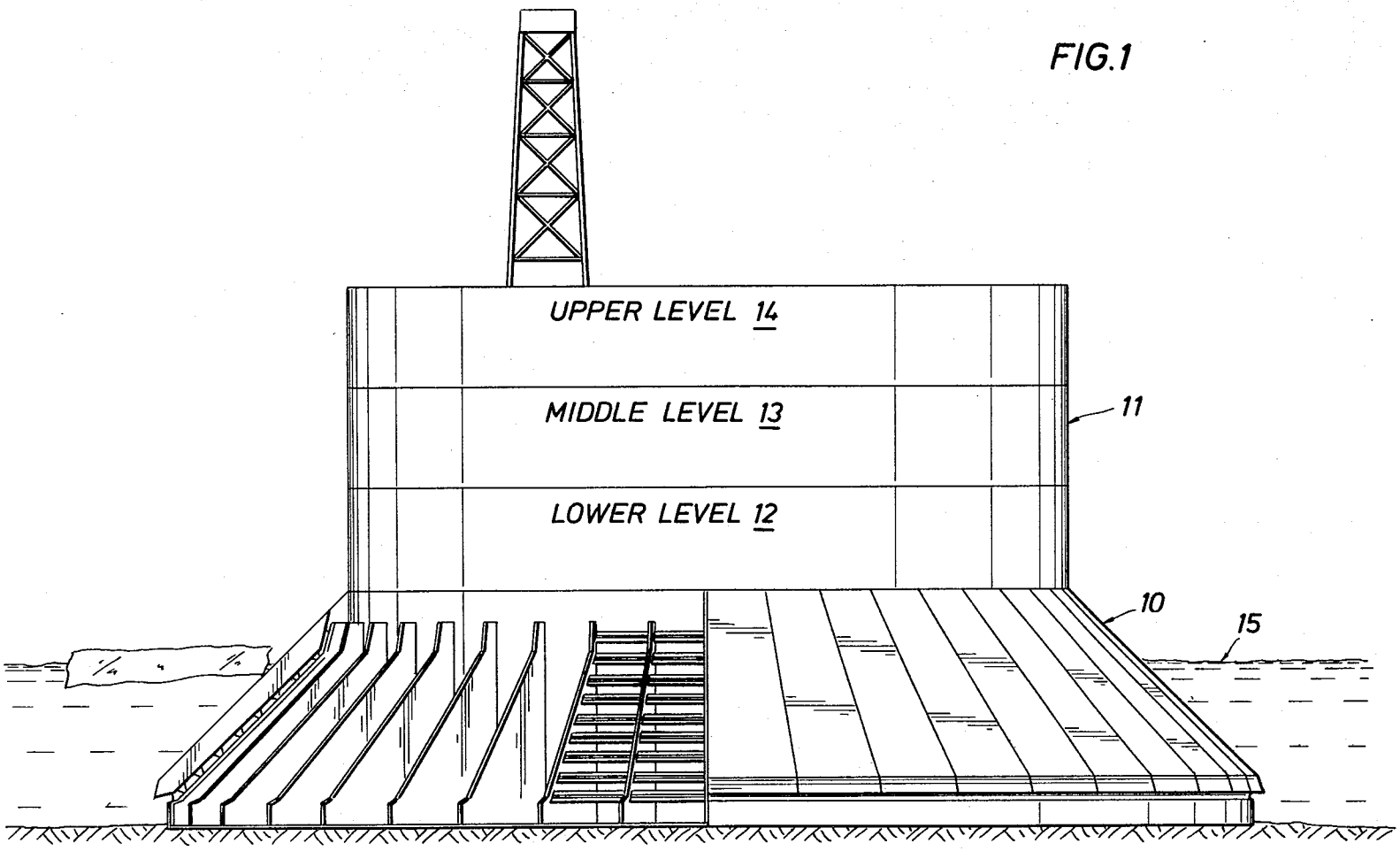
FIG. 1 is a schematic elevation view of the base section of the invention attached to a circular production platform.

Referring now to FIG. 1, there is shown an elevation view of the conical base section 10 coupled to a cylindrical upper section 11 that may be either a drilling or production facility. The upper section is provided with three levels; 12, 13 and 14. which can contain drilling supplies, the drilling equipment, production equipment and living quarters for the drilling or production personnel. The base section is provided with sufficient height so that the upper portion of the truncated conical section extends above the normal water line 15. The extension should be sufficient so that moving ice will ride up the conical section and break due to tension stress before it impacts on the upper section 11.

Figure 2:
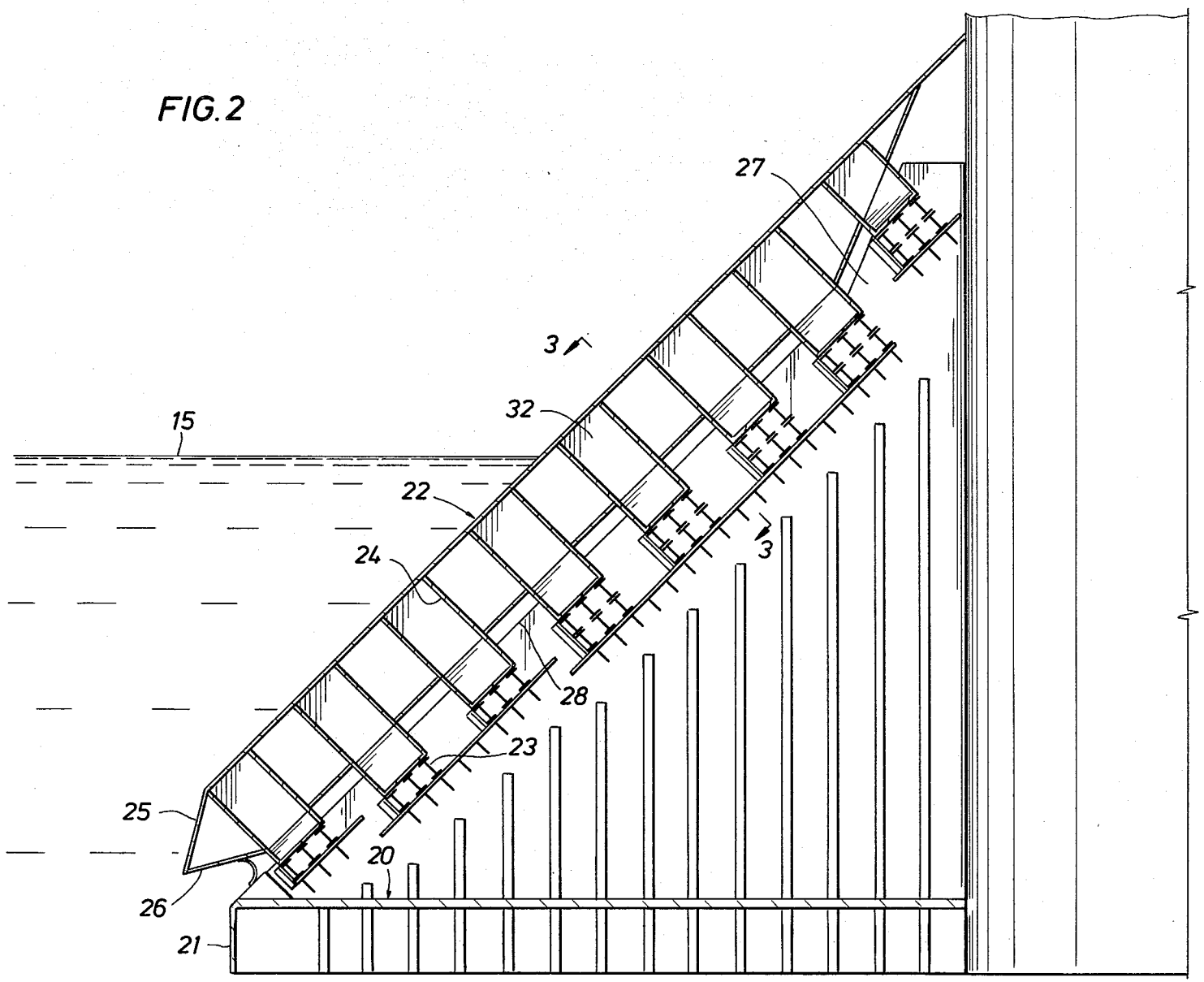
FIG. 2 is a vertical section of the conical base section.

Referring to FIG. 2, there is shown a partial vertical section of the conical base member shown in FIG. 1. The conical base member includes a base plate 20 which is attached to a skirt 21 which extends down into the ocean bottom to assist in anchoring the conical base in position. Normally, the conical base will be ballasted or flooded so that the weight of the conical base, plus the sea water, will cause it to sink and rest on the ocean floor with the skirt 21 penetrating the ocean floor. The base 20 may be constructed of a stiffened plate system. The outer skin 22 of the conical base is actually composed of two spaced-apart plate members having a series of circumferential stiffening webs 24 and meridional webs 32. The actual construction of the outer surface will be described in detail with relation to FIGS. 3 and 4. The space between the outer and inner plates at the lower end of the outer surface is closed by two continuous plate members 25 and 26. The composite outer shell is spaced from the outer ends of the radial bulkheads 27 so that it is free to move within this restricted distance as the supporting beams flex. The flexible beam systems 23 are positioned between the radial bulkheads 27 as particularly shown in FIGS. 5 and 6. As shown, the flexible beam system adjacent the water line is provided with a double set of beams since this is the area which is subject to the greatest load by the moving ice.

Figure 3:
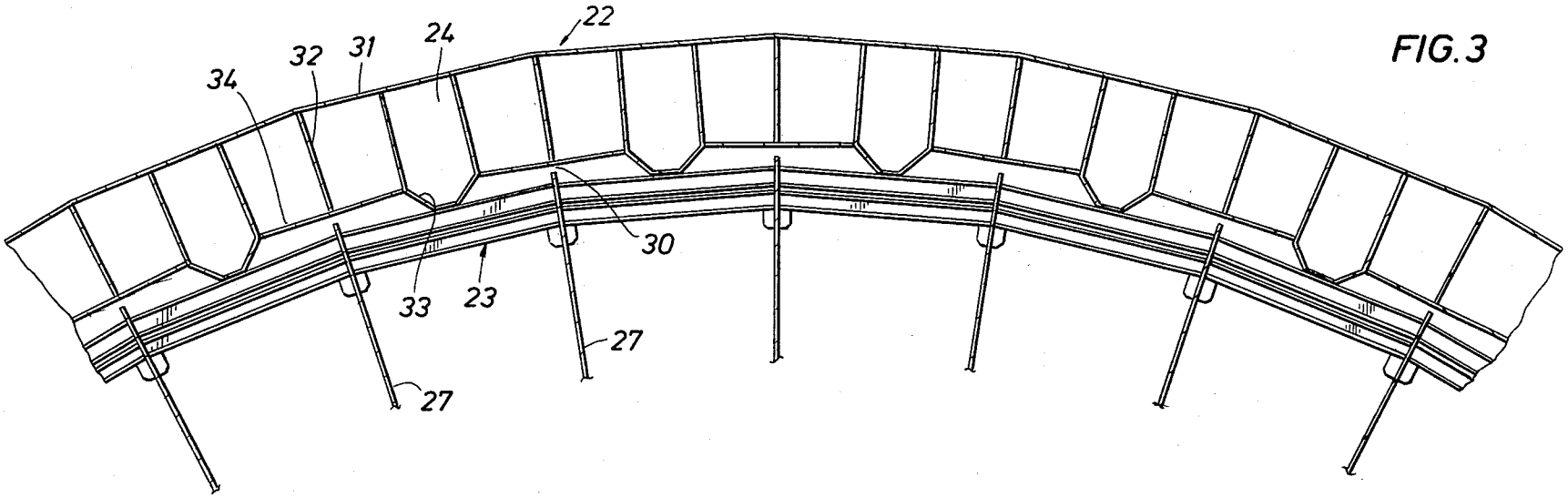
FIG. 3 is a horizontal section taken along line 3—3 of FIG. 2.
Figure 4:
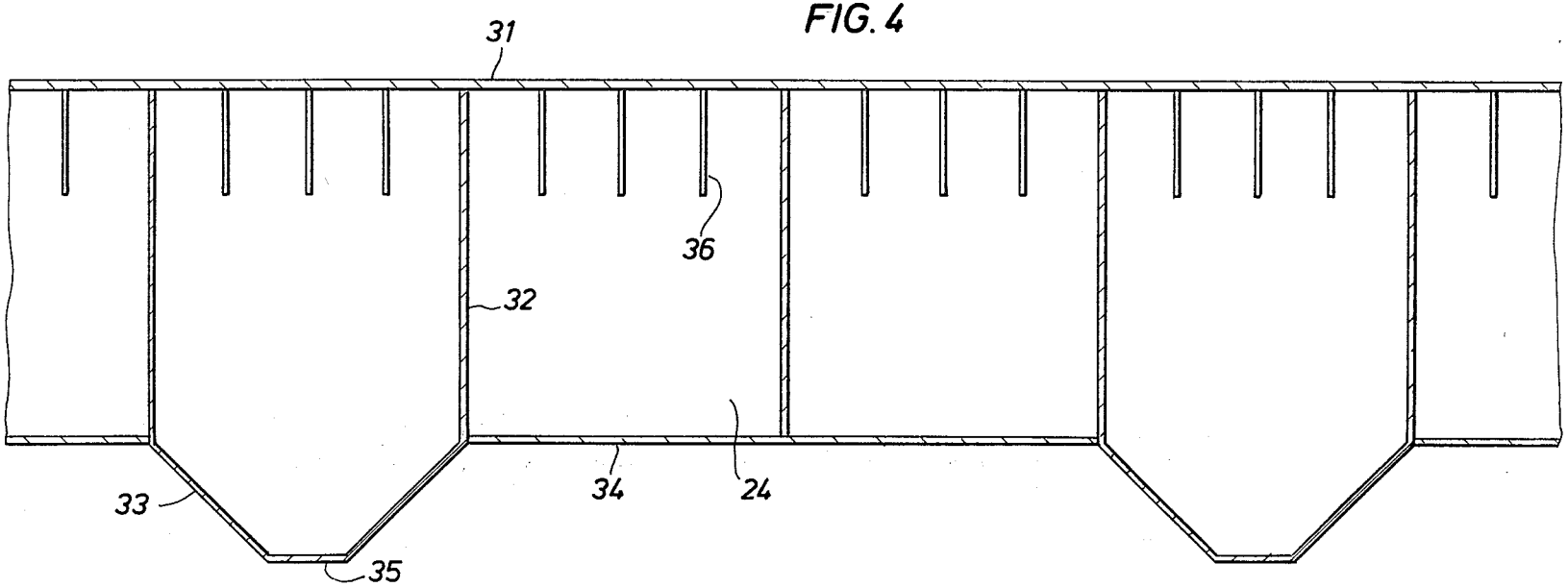
FIG. 4 is a portion of FIG. 3 drawn to an enlarged scale.

Referring now to FIGS. 3 and 4, there is shown the detailed construction of the outer shell and the flexible supporting beams of the conical member. In particular, the outer surface 22 of the base member consists of an outer skin 31 and an inner skin 34 which are spaced apart. The inner and outer skins are held apart by the horizontal or circumferential webs 24 shown in FIG. 2 and a series of meridional webs 32. The combination of the meridional and the circular webs form a cellular or egg crate type structure for the outer shell.

It should be noted that the outer shell is spaced a distance 30 from the ends of the radial bulkheads 27 and supported at the mid-span of the flexible beam system 23 by parallelogram shaped load transfer boxes 33. As shown in FIG. 4, the load transfer box 33 terminates in a flat flange section 35 which contacts the individual beam members. In addition to the meriodional webs 32, a series of secondary stiffening webs 36 are positioned between each of the meridional webs.

Figure 6:
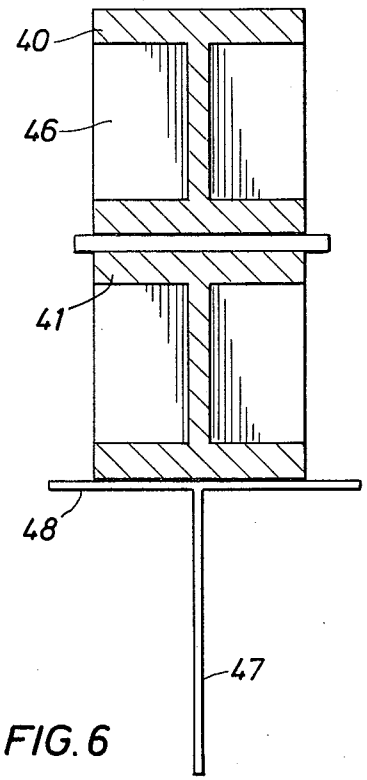
FIG. 6 is a section taken along line 6—6 of FIG. 5.
Figure 5:
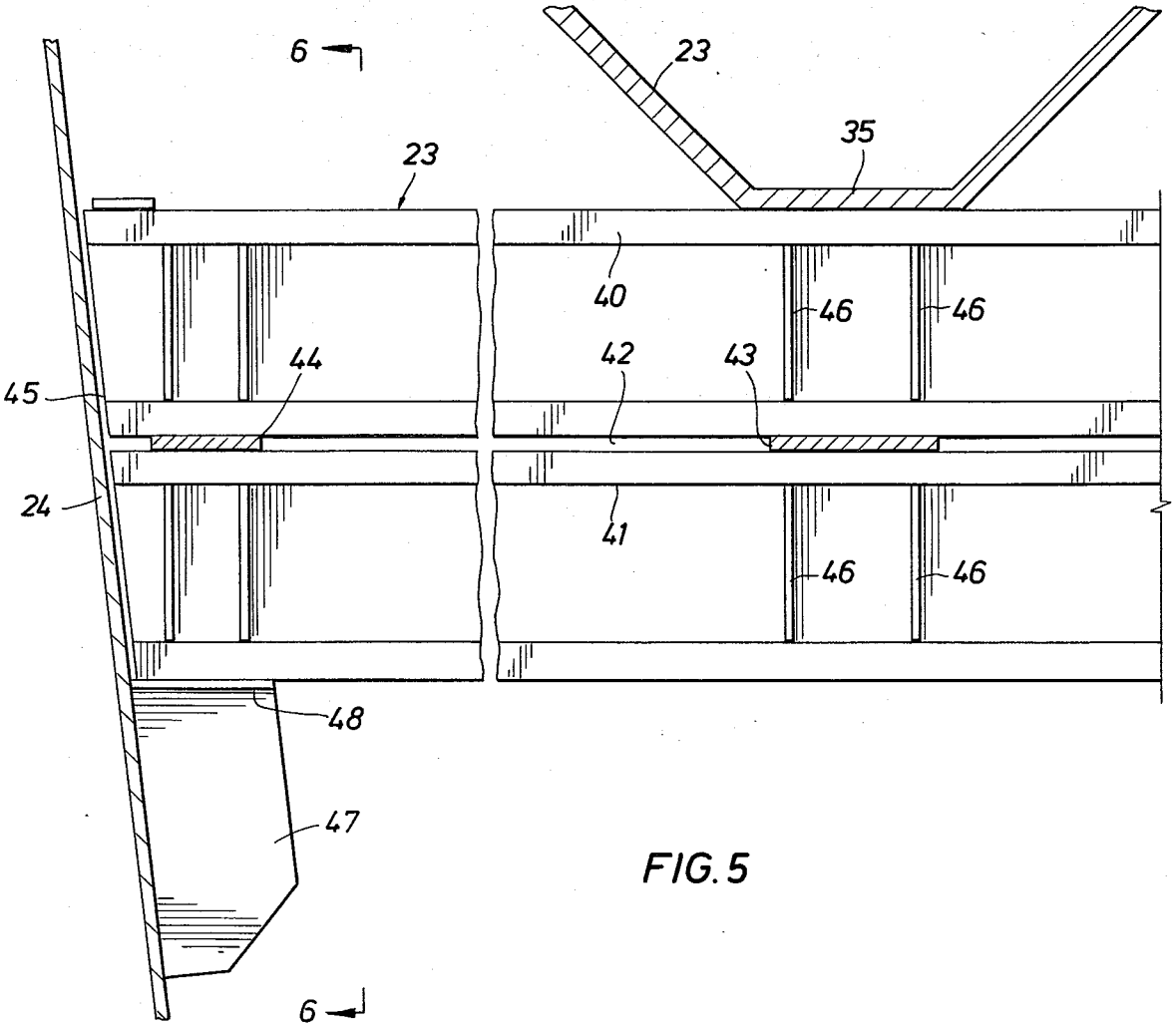
FIG. 5 is a horizontal section of the flexible beam structure.

Referring now to FIGS. 5 and 6 there is shown the details of the flexible beam system used for supporting the outer shell of the conical base. In particular, each flexible beam member of the system adjacent the water line comprises two I-beams 40 and 41 which are spaced apart a short distance 42 by spacing members 43 and 44 positioned at the center and the ends of the beams respectively. The spacing members allow the beams to transmit the load from the outer shell to the radial bulkheads while maintaining their ability to flex with respect to each other without shear transfer. To increase their flexibility the ends of the I-beams have a slight clearance 45 at each end adjacent the radial bulkheads. The end of the innermost beam is supported by a T-section having an end 48 attached to the beams and a web 47 attached to the radial bulkheads. The flanges of the I-beams are reinforced by web members 46 adjacent the center and the ends respectively, to ensure that the load-bearing portions of the beam and the flanges do not buckle or collapse. As best seen in FIG. 5, the flat section 35 of the parallelogram shaped box of the outer shell bears against the outermost flange of the I-beam 40. Thus, the load from the outer shell is transmitted over a narrow area of the beam which permits the beam to slightly flex to absorb the load imposed on the outer shell. Since the beams are not connected at their ends to the radial bulkheads but only supported by the T-sections, the beams can readily flex, absorbing the load from the outer shell. The flexibility of the conical base and limited contact points between the outer shell and supporting structure also prevents excessive loads as a result of temperature fluctuation. Also, an insulating layer can be placed on the inside surface of the outer shell of the conical base and upper cylindrical section to provide thermal insulation.

In a typical base structure designed for a load of 25,000 kips and a maximum contact pressure of 1600 psi, the base structure would have a diameter of approximately 350 feet with a height of roughly 70 feet for operating in water depths of 30 to 60 feet. The upper cylindrical drilling platform is 210 feet in diameter with a height of 90 feet. The outer shell of the conical section includes two-inch outer and two-inch inner plate walls with two-inch meridional webs with one-inch plate radial bulkheads. The radial bulkheads were placed on 9-degree centers while the flexible beam system composed of I-beams having a flange width of approximately 1.5 feet and a thickness of 2.75 inches with a 12-inch high web. The total weight of steel in the structure is approximately 40,000 tons which would provide the reserve buoyancy of approximately 50,000 tons while towing the base structure in an upright position.

The above described conical base structure provides a flexure of approximately two inches when the outer surface of the conical base is subjected to its maximum load of 26,000 kips. In order to withstand greater loads, it may be necessary to increase the diameter of the conical base and increase the thickness or strength of some of the members. While increasing the diameter and the thickness of the members, it should be borne in mind that one should still maintain the flexible beam system.

What is claimed is:

1. An offshore structure for use in arctic water containing moving ice masses comprising:

a frustum base section and a circular upper section, said base section having sufficient height to extend above the surface of the water;

the skin of said frustum section having a controlled stiffness cellular structure formed by an outer plate member and an inner plate member, said outer and inner plate members being separated by a series of radial and meridional webs fastened to said plates to form a cellular structure; and a flexible beam structure, said beam structure being formed by a series of circumferential beams supported by a series of radial bulkheads projecting upward from the bottom of said frustum, said skin being attached to said flexible beam structure intermediate said radial bulkheads.

2. A frusto-conical base member for use in an offshore structure for conducting operations in arctic waters having moving ice, said base member comprising:

a solid circular bottom;

an outer skin for said base, said outer skin being formed by a solid outer plate and a solid inner plate, said inner and outer plates having a general conical shape and radially spaced, a plurality of meridional web members positioned between said inner and outer plates and fasten thereto to maintain the spacing between said plates;

a plurality of radial bulkheads attached to said bottom and terminating short of said outer skin; and a plurality of horizontal flexible beams, said beams being secured between said radial bulkheads to form a series of vertically spaced substantially circular beams, said beams supporting said outer skin at points intermediate said bulkheads.

3. The base member of claim 2 wherein in addition to said meridional members a series of circumferential webs are positioned between said inner and outer plates and fastened thereto.

4. The base member of claim 3 and in addition secondary stiffening webs, said webs being attached to the outer shell and positioned between said meridional members.

5. The base of claim 4 wherein said inner plate is provided with a series of load transfer boxes that project inwardly from said inner plate, said load transfer boxes having a flat surface that contacts said beams at approximately the center thereof.

6. The base member of claim 5 wherein said box has a parallelogram cross section.

* * * * *